United States Patent [19]

Owen

[11] 4,284,171

[45] Aug. 18, 1981

[54] CONVERTIBLE LADDER

[76] Inventor: Graham Owen, 7 Owen Ave., Kyeemagh, Sydney, New South Wales, Australia

[21] Appl. No.: 11,424

[22] Filed: Feb. 12, 1979

[51] Int. Cl.[3] ..... E04G 1/30; E06C 1/32

[52] U.S. Cl. ..... 182/22; 182/27; 182/119

[58] Field of Search ..... 182/119, 118, 27, 25, 182/22, 179

[56] References Cited

U.S. PATENT DOCUMENTS

| | | | |
|---|---|---|---|
| 212,050 | 2/1879 | Phillips | 182/27 |
| 1,207,552 | 12/1916 | Hill | 182/119 |
| 2,656,223 | 10/1953 | Gray | 182/119 |
| 3,108,657 | 10/1963 | Carlson | 182/119 |
| 3,566,990 | 3/1971 | Fredricks | 182/27 |

*Primary Examiner*—Reinaldo P. Machado
*Attorney, Agent, or Firm*—Emory L. Groff, Jr.

[57] ABSTRACT

A convertible ladder is provided which can be set up as an extension ladder, a step ladder or a trestle. A pair of leg assemblies each have a pair of sides connected by a plurality of rungs. Each leg assembly has regularly spaced hooks along its length which engage with the end lugs of a plank member. The plank member has arms provided with lugs which engage another pair of hooks on each leg assembly to form a trestle. The leg assemblies are also provided with a pair of upturned hook lugs which engage a rung of the other leg to form an extension ladder. In the step ladder configuration, the leg assemblies are maintained at maximum angular relationship by means of ties pivotally connected to one leg assembly with openings to engage pins on the other leg assembly.

5 Claims, 7 Drawing Figures

CONVERTIBLE LADDER

This invention relates to a convertible ladder. It may take up an extension ladder form, a step ladder form or a trestle form. The invention is primarily concerned with the provision of the trestle form although not limited thereto.

Trestle arrangements are known in which a plank is end supported on two spaced apart "horses" or is end supported on two spaced apart step ladders or is end supported on other items. The main problems with all the foregoing are that the arrangements lack versatility and are inclined to instability.

The present invention provides a ladder which is versatile and which when in trestle form overcomes the foregoing problems of known trestle arrangements.

Primarily, the invention provides a convertible ladder comprising two leg assemblies each comprising a pair of sides joined by a plurality of rungs, each leg assembly has regularly spaced along its length pairs of hooks with the hooks of each pair on respective sides of the leg assembly to enable a plank member having end lugs to engage in a pair of hooks on each leg assembly and having arms with lugs to engage in another pair of hooks of each leg assembly so as to form with the two leg assemblies a trestle.

Figure 1:
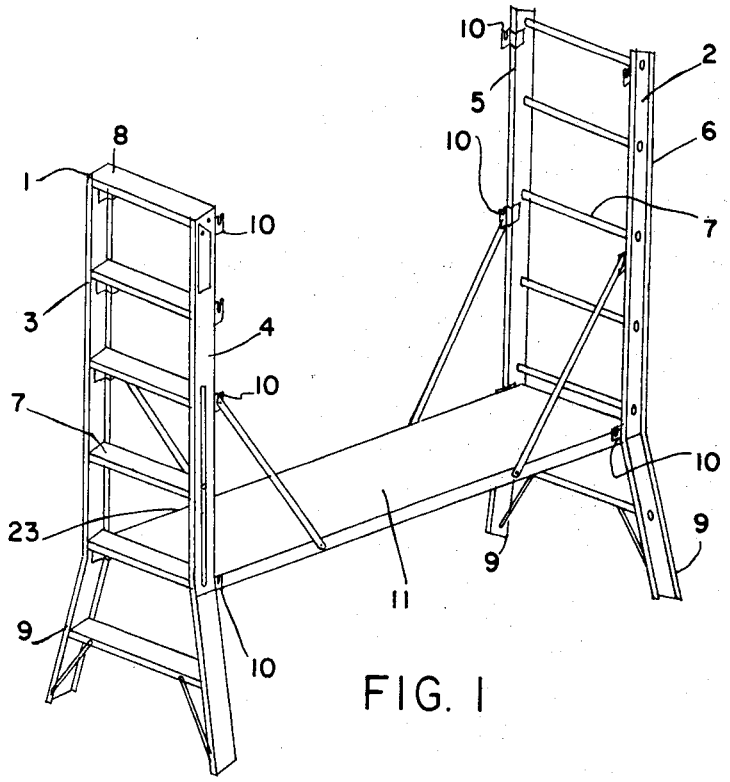
Figure 2:
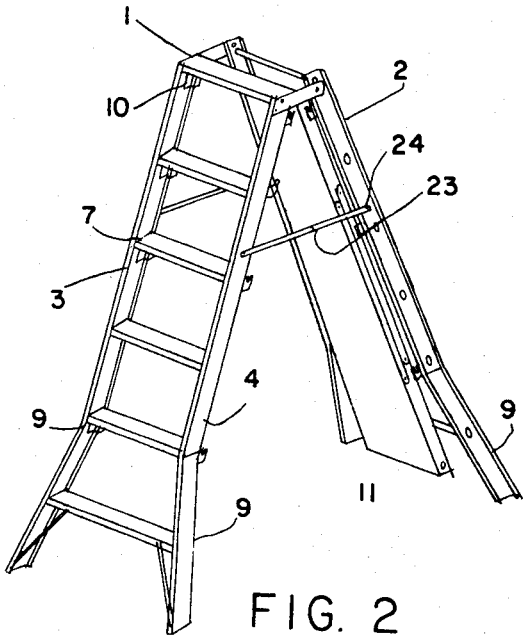
Figure 3:
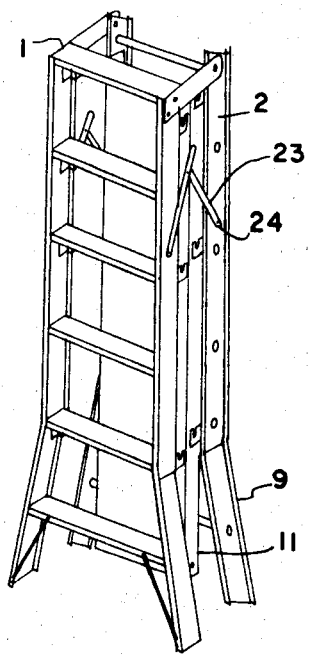
Figure 4:
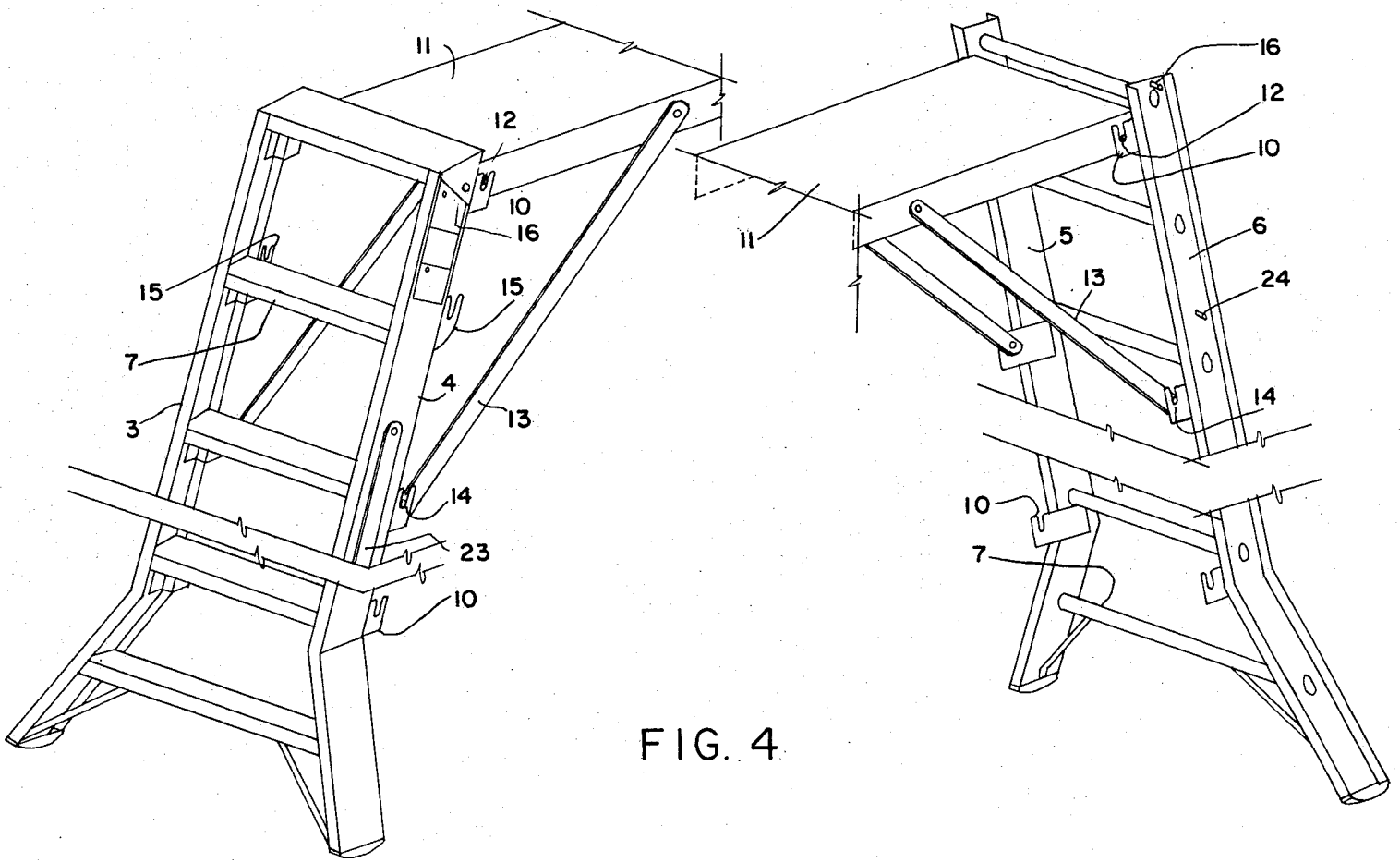
Figure 6:
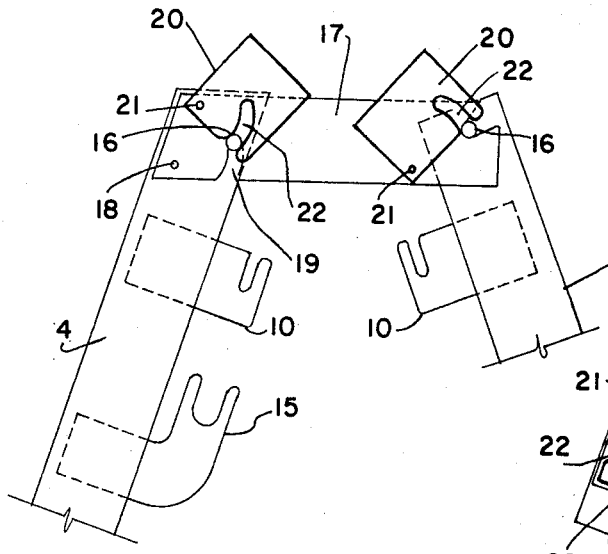
Figure 7:
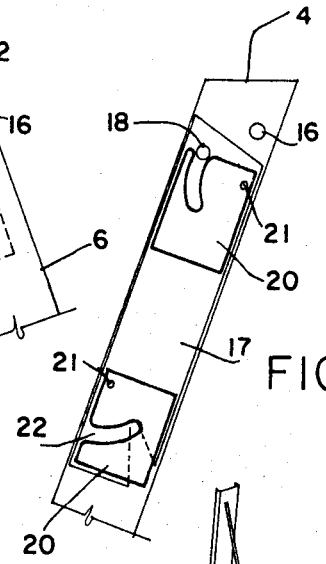
Figure 5:
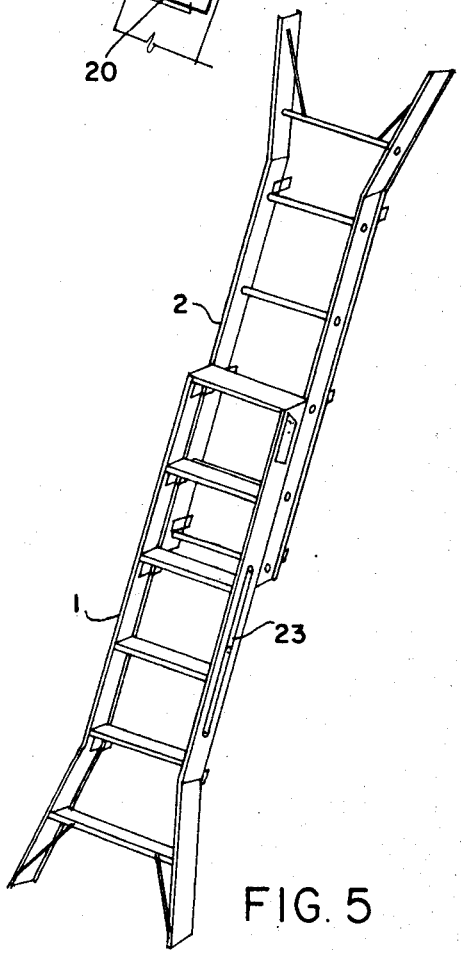

Several configurations of the invention will now be described by way of example with reference to the accompanying drawings in which:

FIG. 1 is a perspective view of the ladder in a first (trestle) configuration with the plank in its lowest position, FIG. 2 is a perspective view of the ladder in a second (step ladder) configuration, FIG. 3 is a perspective view of the ladder in the second configuration when folded for transport, FIG. 4 is an enlarged fragmentary view of the FIG. 1 arrangement with the plank in its upper position, FIG. 5 is a perspective view of the ladder in a third (extension ladder) configuration, FIG. 6 is an enlarged fragmentary view of means for joining the top of the two leg assemblies so as to form the step ladder configuration, and FIG. 7 is a fragmentary view showing the fold-away position for the joining member which permits the formation of the step ladder configuration illustrated in FIGS. 2, 3 and 6.

In FIG. 1 there is two similar leg assemblies 1 and 2 each comprising sides 3,4,5,6 with the sides 3–4, 5–6 being joined by rungs (treads) 7. The sides 3–4 are joined at the top by a joiner rung 8. Each leg assembly has a splayed foot part where the sides 3–4 and 5–6 are outflared, as at 9.

In FIG. 4, in particular, it will be seen that each leg assembly has along its length at regularly spaced intervals pairs of up facing hooks 10 with the hooks of each pair on the respective sides of the leg assembly. There is a plank 11 which has end lugs 12 to engage in the hooks 10. The plank 11 has pivotally connected arms 13 with lugs 14 to engage in other pairs of the hooks 10. The length of the arms 13 and the spacing apart of the hooks 10 is such that the plank 11 can be suspended as in FIG. 1 or supported as in FIG. 4. Intermediate positions are of course provided depending upon the number and/or positioning of the hooks 10. Irrespective of whether the plank 11 is suspended or supported there is a bracing restraint applied by the arms 13 to maintain the leg assemblies/plank member in an assembled substantially rigid trestle configuration.

The sides 3–4 of the leg assemblies also have a pair of upturned hook lugs 15 to engage in a rung 7 of the other leg assembly to form the extension ladder configuration shown in FIG. 5. There is no need for other attachment means as the sides 5–6 of the one leg assembly bear against the rear faces of the other sides 3–4 if the ladder is used as shown in FIG. 5. Catch means may be used if required.

As best seen in FIG. 6, the sides 3–4 and 5–6 both include pins 16 and leg assembly sides 3–4 have bridging members 17 pivoted as at 18 to the sides 3–4. The bridging members 17 each have two curved slots 19 to respectively engage the pins 16 of the sides 3–4 and the pins 16 of the sides 5–5. The pins 16 are retained in the slots by locking plates 20. The plates 20 are pivotally connected to the bridging members 17 as at 21 and include slots 22 to also engage the pins 16. The position of pivoting of the plates 20 and the shape of the slots at 22 are such that the plates 20 must be physically raised to enable the slots 19 to be disengaged from the pins 16. In the step ladder configuration the leg assemblies are maintained at maximum angular relationship by means of ties 23. The ties 23 can be of any suitable type and as shown are of the articulated rigid section type, pivotally connected to one leg assembly with openings to engage pins 24 of the other leg assembly.

As will be seen in FIGS. 2 and 3 the plank member 11 can be retained in place whilst the ladder takes up the third or step ladder configuration. This also makes for ease of transportation.

Whilst hooks and lugs and pins have been hereinbefore described, and this terminology is carried through into the claims of this patent application, it is to be understood that reverse arrangements are to be considered as being covered by the invention as are equivalent arrangements.

The members, i.e. the leg assemblies and plank are preferably made of metal.

The plank may have surface roughness to provide a sure footing for a user.

I claim:

1. A convertible ladder comprising two leg assemblies each comprising a pair of sides joined by a plurality of rungs, pairs of regularly spaced hooks on each leg assembly the length thereof, a plank member including end lugs engaging in a pair of hooks on each leg assembly, said plank member further including arms provided with lugs engaging in another pair of hooks on each leg assembly, a pair of bridging members respectively pivotally mounted on the sides of one leg assembly at the upper end thereof, each bridging member having a slot at each end thereof, pins on corresponding upper end parts of each side engaging in said slots, catch members pivotally mounted on said bridging members so as to overlie the slots in said bridging members and fit over said pins to prevent the bridging means slots from disengagement from said pins.

2. A ladder as claimed in claim 1 wherein one leg assembly has a further pair of hooks to engage a rung of the other leg assembly when the leg assemblies are placed in overlying relationship to form an extension ladder configuration.

3. A ladder as claimed in claim 1 including tie means to limit maximum angular deviation between the leg assemblies.

4. A ladder as claimed in claim 1 having the lower portion of each side of each leg assembly splayed outwardly.

5. A ladder as claimed in claim 1 wherein the component parts are made of metal.

* * * * *